United States Patent [19]

Riddell et al.

[11] 4,181,567

[45] Jan. 1, 1980

[54] PAPER MANUFACTURE EMPLOYING FILLER AND ACRYLAMIDE POLYMER CONGLOMERATES

[75] Inventors: Martin C. Riddell, 15 Nurseries Rd., Kidlington, Oxfordshire, England; Ian M. Waring, Johannesburg, South Africa

[73] Assignee: Martin Clark Riddell, Kidlington, England

[21] Appl. No.: 850,625

[22] Filed: Nov. 11, 1977

Related U.S. Application Data

[63] Continuation of Ser. No. 703,795, Jul. 9, 1976, abandoned.

[30] Foreign Application Priority Data

Jul. 17, 1975 [GB] United Kingdom ..... 30127/75

[51] Int. Cl.[2] ..... D21D 3/00

[52] U.S. Cl. ..... 162/168 NA; 162/181 R; 162/181 A; 162/181 B; 162/181 D; 162/183

[58] Field of Search ..... 162/181 A, 181 B, 181 R, 162/168 NA, 183, 181 D; 210/54

[56] References Cited

U.S. PATENT DOCUMENTS

| | | | |
|---|---|---|---|
| 2,917,426 | 12/1959 | Bugosh | 162/181 A |
| 3,117,944 | 1/1964 | Harrell | 162/181 A |
| 3,252,852 | 5/1966 | Lagally | 162/169 |
| 3,492,225 | 1/1970 | Ryznar | 210/54 |
| 3,597,251 | 8/1971 | Kaufman | 161/181 A |
| 3,873,336 | 3/1975 | Lambert | 162/181 A |

FOREIGN PATENT DOCUMENTS

| | | | |
|---|---|---|---|
| 883973 | 12/1961 | United Kingdom | 162/168 NA |
| 1353015 | 5/1974 | United Kingdom . | |

OTHER PUBLICATIONS

Reynolds et al "A New Polyacrylamide-Type Flocc. for Imp. Fill. Ret." Tappi, vol. 40, No. 11 pp. 918-920.

Casey "Pulp & Paper" vol. II, (1960) p. 947.

*Primary Examiner*—S. Leon Bashore

*Assistant Examiner*—Peter Chin

*Attorney, Agent, or Firm*—Finnegan, Henderson, Farabow & Garrett

[57] ABSTRACT

A method of increasing the amount of mineral filler which can be contained in filled paper sheet produced on a papermaking machine without consequentially reducing the mechanical properties such as the tensile strength of the paper sheet comprises incorporating the mineral filler into the paper pulp furnish, before the latter is transferred to the wire, in the form of a filler/-polymer conglomerate formed by contacting the mineral filler with a relatively high molecular weight polymer having a zeta potential in the range of from −40 to +40 electron volts.

14 Claims, No Drawings

PAPER MANUFACTURE EMPLOYING FILLER AND ACRYLAMIDE POLYMER CONGLOMERATES

This is a continuation, of application Ser. No. 703,795, filed July 9, 1976 now abandoned.

BACKGROUND OF THE INVENTION

1. Field of the Invention

This invention relates to the manufacture of paper and is concerned with a method of increasing the content of mineral fillers (also known as loadings) in paper sheet.

2. Description of the Prior Art

In the manufacture of paper sheet it is customary to incorporate in the aqueous paper pulp (also known as the furnish) before it is transferred to the continuous wire mesh (known as the "wire") at the wet end of the papermaking machine a mineral filler the purpose of which is primarily to improve the surface of the paper for printing purposes and to reduce the production costs. However there is a practical limit to the amount of filler which can be employed in this manner owing to the fact that as filler content increases the tensile strength of the paper sheet decreases. This is because the filler particles interfere with the hydrogen bonding between cellulose fibres and because with increased filler content there is less fibre present in the paper sheet to impart strength thereto.

It is known to incorporate, normally just ahead of the wire, small amounts of polymeric materials in the dilute aqueous paper pulp/filler suspensions known as "thin stock" to give improved retention of the filler on the wire during sheet formation and hence improve the efficiency of the papermaking process by reducing filler losses, generally referred to as white water losses. For instance, British Patent Specification No. 883,973 describes the use as a retention aid of trace amounts of a water-soluble non-cationic linear vinyl polymer having a molecular weight of at least $5\times10^6$ and at least predominantly composed of carbamoylalkylene linkages containing not more than 4 carbon atoms, the polymer being added to the filler-containing aqueous suspension of cellulose fibres prior to sheet formation of the wire.

British Patent Specification No. 1,353,015 describes a method of reducing the chemical reactivity of calcium carbonate filler in a papermaking process involving sizing under acid conditions, such as the traditional rosin soap/papermakers' alum sizing process, by protecting the calcium carbonate particles with a coating formed by adding a selected gellable hydrophilic organic material to an aqueous suspension of the calcium carbonate particles and thereafter causing the said material to gel by means of a suitable gellant so as to form aggregates of gelled hydrophilic material and calcium carbonate particles. Under certain conditions aggregates of a fibrous character may be formed. In such filliform entities, a number of filler particles are associated with one another and gelled in a linear form, so as to provide the particles with a protective coating. The use of the protected calcium carbonate filler is stated to give a slightly increased loading retention without reducing the paper strength.

In German Offenlegungsschrift No. 2516097 it is proposed to incorporate increased amounts of calcium carbonate filler in paper without consequentially reducing the strength of the paper by incorporating into the paper pulp calcium carbonate in the form of a mixture of calcium carbonate with an aqueous latex of a film-forming polymeric binder such as a styrene-butadiene latex.

Since mineral fillers are considerably cheaper than virgin cellulose fibre, it would be a considerable commercial advantage if the filler content of paper sheet could be substantially increased above the maximum quantities presently possible whilst at the same time maintaining the tensile strength and other physical characteristics of the sheet.

Filler particles in solution or suspension normally have an electrostatic charge. Generally the filler particle will be negatively charged, but in some cases it may have a positive charge depending on the hardness of the water, since an excess of positive ions will be present if the water is hard.

SUMMARY OF THE INVENTION

We have now found in accordance with the present invention that certain long chain relatively high molecular weight polymers have the capability of attracting thereto a plurality of filler particles so as to form a filler/polymer conglomerate in which the numerous filler particles are retained in position by electrostatic attraction between the filler particles and the polymer and by polymer bridging effects, and that such conglomerates can be used in the manufacture of paper sheet in order to increase the filler content of the sheet without substantially affecting the physical strength characteristics of the paper sheet, since the filler/-polymer conglomerates reduce the deleterious effect of the filler on the hydrogen bonding of the fibres. We have also found that such filler/polymer conglomerates are capable of withstanding to a considerable degree the various shear forces which are normally present in a conventional papermaking system.

Thus in accordance with one aspect of the invention, there is provided a method of manufacturing paper sheet by means of a papermaking machine employing an aqueous paper pulp containing a mineral filler, characterized in that the mineral filler is incorporated into the paper pulp in the form of a filler/polymer conglomerate formed by contacting a particulate mineral filler with a polymer having a zeta potential in the range from $-40$ to $+40$ electron volts and a molecular weight of at least $2\times10^6$.

In accordance with another aspect of the invention, there is provided as a novel composition of matter a filler/polymer conglomerate formed by contacting a particulate mineral filler with a polymer having a zeta potential in the range from $-40$ to $+40$ electron volts and a molecular weight of at least $2\times10^6$.

DETAILED DESCRIPTION OF THE INVENTION

The long chain relatively high molecular weight polymers which are capable of forming such filler/-polymer conglomerates have a zeta potential (ZP) in the range from $-40$ to $+40$ electron volts (ev) and a molecular weight of at least $2\times10^6$, preferably $2\times10^6$ to $20\times10^6$ and more preferably in the range from $4\times10^6$ to $12\times10^6$. Advantageously the zeta potential is around zero or slightly negative, i.e. in the range from $+5$ to $-20$ ev, and the molecular weight is in the range from about 5 to $10\times10^6$.

The zeta potential (or electrokinetic potential) is defined as the electric potential across the diffuse part of the double layer of ions surrounding a charged particle in an ionic liquid, such as water. Thus when for instance an electronegatively charged polymer is dissolved in water, the polymer attracts a large number of electropositive ions which form a thin concentrated layer adjacent thereto. Outside this thin layer is a thicker more diffuse layer in which the electropositively charged ions in the water are only mildly attracted to the electronegatively charged polymer particle. It is the electric potential across this diffuse layer which is termed the zeta potential.

Zeta potential can be measured using a 0.1% by weight solution of the polymer in deionized water and an electrophoresis device, for example a "Zeta-Meter" or "Laser Zee Meter".

The polymers used in the pressure invention may be positively or negatively charged depending on the charge associated with the filler. Examples of polymers which have been found to give particularly good results are high molecular weight polyacrylamides, which may be homopolymers or copolymers of acrylamide. The molecular weights of these polymers are conventionally determined by intrinsic viscosity measurements in normal (N) sodium chloride solutions.

The homopolymers of acrylamide, which are normally essentially non-ionic, contain the repeating unit:

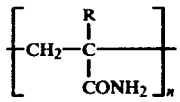

wherein R is hydrogen (polyacrylamide) or methyl (polymethacrylamide).

The copolymers of acrylamide may be anionic in character, by the presence therein of a number of anionic groups (Y) in place of some of the $CONH_2$ groups, or cationic in character, by the presence therein of a number of cationic groups (X) in place of some of the $CONH_2$ groups. Thus the copolymers may contain the repeating units:

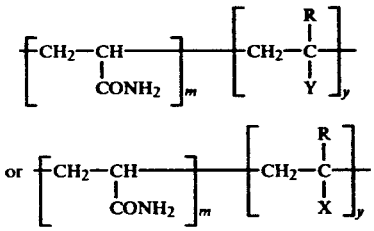

in which Y may represent, for example, a carboxylic acid group (COOH) or an ammonium, alkali metal, amine or substituted amine salt of said group, or an analogous sulphonate salt; X may represent, for example, a substituted amide group or a corresponding quaternary ammonium salt cation thereof; and m and y may vary to give a weight percent ratio between 100:0 and 50:50, i.e. up to 50 mol % of anionic or cationic groups may be present in the polymer. Alternatively the copolymers may be non-ionic, if the copolymerizing monomer is a non-ionic vinyl monomer such as, for example, acrylonitrile or ethyl acrylate. Such copolymers of acrylamide may have molecular weights in the range from 2 to $20\times10^6$.

The size of the filler/polymer conglomerate will depend on the particular polymer used, but can be varied by adjusting the weight ratio of polymer to filler. For example the conglomerate may contain from 0.01 to 0.5% by weight of dry polymer, based on dry weight of filler. Preferably the conglomerate has an average diameter in the range from 50 to 100 microns. Advantageously the conglomerates are of a size such that upon being subjected to shear forces, such as experienced on a papermaking machine, at least the major proportion thereof will assume a filliform shape which enhances the hydrogen bonding of the cellulose fibres and the filler retention without detracting from the appearance of the paper sheet.

The mineral filler used in the production of the filler/polymer conglomerate may be, for example, calcium carbonate, which may be used in any of its commercially available forms such as, for example, natural chalk whiting. Alternatively, the filler may be, for example, china clay, talc or titanium dioxide. If desired a mixture of different fillers may be used.

The filler/polymer conglomerates of the invention can be prepared by adding the polymer, preferably in the form of a solution in water, to an aqueous suspension of the filler containing, for example, from 20 to 35% by weight of filler and, if desired, applying a low shearing force to the resulting mixture, for example by passing the mixture through a static mixer, in order to reduce any variation in the particle size of the conglomerates. The production of the conglomerates can be carried out batchwise or continuously, and the size of the conglomerate particles can be adjusted by varying the rate of addition of the polymer. The conglomerates produced in this manner can then be used in an otherwise conventional papermaking system in place of the normal filler particles. Thus they can be incorporated in the furnish before the latter is applied to the wet end of the papermaking machine in a known manner. If required, the conglomerates can be passed through one or more additional shearing devices, for example stock cleaners, mechanical screens or fan pumps, in which they can be subjected to an adjustable shear force, prior to being fed into the papermaking system.

Advantageously the conglomerates are prepared by continuous addition of an aqueous solution of the high molecular weight polymer, for example a high molecular weight substantially non-ionic polyacrylamide solution, to a flowing aqueous suspension of mineral filler, for example calcium carbonate, and then passing the resulting aqueous suspension of filler/polymer conglomerates through a static mixer, from which the resulting low sheared conglomerate suspension can be fed into a flowing aqueous paper pulp which is being fed to the wet end of a papermaking machine. When preparing and using the conglomerates in the foregoing continuous manner, it is advantageous to feed the conglomerate suspension into the papermaking system through a feed pipe at least part of which is transparent so that the particle size and structure of the conglomerates can be observed and if necessary adjusted.

If desired, conventional wet-strength or dry-strength resins or a starch (which may be an oxidised starch) can be present during the formation of the filler/polymer conglomerates, since it has been found that the presence of such resin or starch helps to improve still further the mechanical stability which the conglomerates normally possess to a considerable degree as previously mentioned. Examples of such resins are polyamide-epichlorohydrin or polyamide/polyamine epichlorohydrin wet strength resins and melamine formaldehyde dry-strength resins. The latter may be sulphited so as to be alkaline and anionic in charge. These resins, or starch, may be added either to the polymer or to the aqueous filler suspension prior to the contacting of the filler and the polymer. Wet and dry strength resins are normally commercially available in the form of aqueous solutions and may be added in an amount of, for example, from 0.02 to 0.8 weight % of aqueous solution, based on the weight of polymer.

The papermaking process of the invention can be carried out using a conventional furnish formed partly from hardwood and partly from softwood and if desired incorporating an internal sizing agent, for example an aqueous ketene dimer emulsion such as the commercially available product "Aquapel" marketed in the United Kingdom by Hercules Powder Company Limited.

The filler/polymer conglomerates produced in accordance with the invention can be employed in an alkaline papermaking system, i.e. a system in which the paper stock is maintained at an alkaline pH value; alternatively the filler/polymer conglomerates may be used in an acid papermaking system, i.e. one having paper stock at an acid pH value, either with an inert filler such as china clay or surprisingly even with a filler which is normally reactive in an acid system, such as calcium carbonate which is relatively cheap and readily available, since conglomerates formed with calcium carbonate in accordance with the invention have surprisingly been found to exhibit substantial resistance to acid attack.

It has been found that by using filler/polymer conglomerates in accordance with the invention, it is possible to increase the filler content in the finished paper sheet by a value in the range from 25 to 60% increase compared with paper formed with normal filler and yet maintain the strength and other physical properties desired in the finished paper sheet. Thus as a result of the invention it is possible to replace relatively expensive virgin cellulose fibre by relatively cheap filler.

The following non-limitative Examples illustrate how the invention may be carried into effect.

EXAMPLE 1

This Example illustrates the use of the invention in an alkaline papermaking system with whiting as filler.

A paper pulp furnish was made up in a conventional manner from fully bleached chemical pulps and recycled broke (made from a similar furnish), so that the furnish comprised 34 weight % of hardwood, 36 weight % of softwood and 30% of the recycled broke. An alkaline internal sizing agent, namely the commercially available product "Fibran" marketed in the United Kingdom by Laing-National, was incorporated in the furnish, which then had a pH of 7.2.

A commercially available homopolymer of acrylamide (having a zeta potential of −14 ev (measured with a 0.1% by weight solution in distilled water on a Laser Zee Meter), a molecular weight of about $8\times10^6$ and a viscosity equal to 92 c.p. units at 15° C. measured with a 0.5% by weight solution on a RVT Brookfield Viscometer at 50 r.p.m.) was dissolved in city water (having a total hardness of approximately 300 ppm.) to give a 0.5% w/w solids polyacrylamide solution. The viscous solution produced in this manner was pumped at a flow rate of about 180 liters per hour through a positive displacement pump into a feed line through which was passing a 25% w/w aqueous slurry of natural chalk whiting (calcium carbonate) filler (sold in the United Kingdom as Snowcal 8.SW by The Cement Marketing Company Limited) at a flow rate of 30 liters per minute, so as to give a percentage addition of polymer solution to wet filler flow of about 10%. The polyacrylamide solution was fed into the filler feed line immediately after the dilution water addition point and just before a static mixer. The dilution water was fed into the filler feed line at a rate such as to give a dilution factor of about 3 to 1.

The effluent from the static mixer which comprised chalk whiting/polyacrylamide conglomerates suspended in water, the conglomerates having an average diameter in the range of 50 to 100 microns, was fed through a transparent plastics pipe into the thinstock flow in the approach flow shortly before the flowbox. A solution in water of a polyamine retention aid, namely the commercially avilable product "Natron 88" (sold in the United Kingdom by Laing-National) was added immediately before the flowbox to retain fines and to maximise size retention.

Cream wove paper was then produced on a papermaking machine using a slightly alkaline system having a zeta potential of about zero. Paper was produced at 400 Kg. per hour at the reel end at a reel end speed of 242 meters per minute.

The following Table indicates the physical results obtained with the paper produced in accordance with the invention as described in the foregoing Example compared with the results obtained with paper produced in an identical manner save that untreated calcium carbonate filler was used in the conventional manner instead of the filler/polymer conglomerates.

| | Basis weight (sheet) QSM | % total ash | Basis weight (fibre) QSM | Burst strength based on 100 g. fibre | Breaking length meters on sheet |
|---|---|---|---|---|---|
| Conglomerate | 80 | 29 | 56.8 | 396 | 6210 |
| $CaCO_3$ filler | 75 | 18 | 61.5 | 390 | 6170 |

It can be seen from the foregoing results that by employing the present invention the filler content of the paper sheet was substantially increased without any deterioration in the sheet strength.

EXAMPLE 2

This Example illustrates the use of the invention in an alkaline papermaking system with china clay as filler.

Teleprinter paper was produced in a manner similar to that described in Example 1 except that Lee Moor grade B lump china clay (English Clays Lovering Pochin & Co. Limited) was used in place of the natural chalk whiting filler.

The following Table illustrates the physical results obtained compared with the results obtained using untreated china clay in the conventional manner.

| | Basis weight (sheet) qsm | % total ash | Basis weight (fibre) qsm | Burst strength based on 100 g. fibre | Breaking length meters on sheet |
|---|---|---|---|---|---|
| Conglomerate | 73.0 | 20 | 58.4 | 275 | 6520 |
| China clay | 70.5 | 14 | 60.7 | 231 | 5500 |

It can be seen from the foregoing results that by use of the invention, the filler content was substantially increased without any deterioration in the physical strength properties of the sheet.

EXAMPLE 3

This Example illustrates the use of the invention in an acid papermaking system with whiting as filler and a wet strength resin present during formation of the filler/polymer conglomerates.

A paper pulp furnish was made up in a conventional manner from fully bleached chemical pulps and recycled broke (made from a similar furnish), so that the furnish comprised 45 weight % of hardwood, 40 weight % of softwood and 15% of the recycled broke. A rosin-/alum sizing agent was incorporated in the furnish, which then had a pH of about 6.3.

A commercially available non-ionic homopolymer of acrylamide (having a molecular weight of about $5\times10^6$ and a viscosity equal to 82 c.p. units at 15° C. measured with a 0.5% by weight solution on a RVT Brookfield Viscometer at 50 r.p.m.) together with 0.05% by weight, based on the weight of polyacrylamide, of a commercially available aqueous solution of a polyamide-epichlorohydrin wet-strength resin (sold in the United Kingdom as Kymene 557 by Hercules Powder Company Limited) were dissolved in city water to give a 0.3% w/w solids polyacrylamide solution having a zeta potential of −2 ev. The viscous solution produced in this manner was pumped at a flow rate of about 80 liters per hour through a positive displacement pump into a feed line through which was passing a 35% w/w aqueous slurry of natural chalk whiting (calcium carbonate) filler (sold in the United Kingdom as Snowcal 4ML by The Cement Marketing Company Limited) at a flow rate of 900 liters per hour, so as to give a percentage addition of polymer solution to wet filler flow of about 8.8%. The polyacrylamide solution was fed into the filler feed line and the resultant mixture fed through a static mixer to ensure thorough blending.

The effluent from the static mixer which comprised chalk whiting/acrylamide conglomerates suspended in water, the conglomerates having an average diameter in the range of 60 to 65 microns, was fed through a transparent plastics pipe into the second stage cleaners for the furnish. A solution in water of a polyacrylamide retention aid, namely the commercially available product Percol (sold in the United Kingdom By Allied Colloids) was added immediately before the flowbox to retain fines and to maximise size retention.

High quality board was then produced on a papermaking machine using a slightly acid system having a zeta potential of approximately zero. Paper was produced at 1850 Kg. per hour at the reel end at a reel end speed of 95 meters per minute.

The following Table indicates the physical results obtained with the board produced in accordance with the invention as described in the foregoing Example compared with the results obtained with board produced in an identical manner save that untreated calcium carbonate filler was used in the conventional manner instead of the filler/polymer conglomerates.

| | Basis weight (sheet) QSM | % total ash | Basis weight (fibre) QSM | Burst strength based on 100 g. fibre | Breaking length meters on sheet |
|---|---|---|---|---|---|
| Conglomerate | 146 | 18.7 | 118 | 284 | 6525 |
| $CaCO_3$ filler | 150 | 13.7 | 136.5 | 260 | 6480 |

It can be seen from the foregoing results that by employing the present invention, the filler content of the paper sheet was substantially increased without any deterioration in the sheet strength. Thus the percentage increase on ash content was 36%, whilst the percentage increases on burst strength and breaking length (i.e. tensile strength) were 9.2% and 0.6% respectively.

It should also be noted that in this process, no problems were caused by the use of whiting as filler in an acid system as normally occur with whiting in its conventional form.

EXAMPLE 4

This Example illustrates the use of the invention in an acid papermaking system with china clay as filler and a wet strength resin present during formation of the filler/polymer conglomerates.

A paper pulp furnish was made up in a convention manner from fully bleached chemical pulps and recycled broke (made from a similar furnish), so that the furnish comprised 55 weight % of hardwood, 35 weight % of softwood and 10% of the recycled broke. Sufficient rosin/alum sizing agent was incorporated in the furnish to give a pH value of 5.5.

A commercially avaiable homopolymer of acrylamide (having a molecular weight of about $5\times10^6$ and a viscosity equal to 82 c.p. units at 15° C. measured with a 0.5% by weight solution on a RVT Brookfield Viscometer at 50 r.p.m.) together with 0.05% by weight, based on the weight of polyacrylamide, of a commercially available aqueous solution of a polyamide-epichlorohydrin wet-strength resin (sold in the United Kingdom as Kymene 557 by Hercules Powder Company Limited) were added to city water to give a 0.3% w/w solids polyacrylamide solution having a zeta potential of +1 ev. The viscous solution produced in this manner was pumped at a flow rate of about 220 liters per hour through a positive displacement pump into a feed line through which was passing a 25% w/w aqueous slurry of filler grade china clay at a flow rate of 2450 liters per hour, so as to give a percentage addition of polymer solution to wet filler flow of about 9.0%. The polyacrylamide solution was fed into the filler feed line and the resultant mixture fed through a static mixer to ensure thorough blending.

The effluent from the static mixer which comprised china clay/polyacrylamide conglomerates suspended in water, the conglomerates having an average diameter in the range of 50 to 55 microns, was fed through a transparent plastics pipe into the papermaking system at a point before the mechanical screens for the furnish. A solution in water of a polaymide retention aid, namely the commercially available product Retaminol C (sold in the United Kingdom by Bayer) was added immediately before the flowbox to retain fines and to maximise size retention.

Woodfree continuous stationery was then produced on a papermaking machine using an acid system having a slightly positive zeta potential. Paper was produced at 4200 Kg. per hour at the reel end at a reel end speed of 600 meters per minute.

The following Table indicates the physical results obtained with the paper produced in accordance with the invention as described in the foregoing Example compared with the results obtained with paper produced in an identical manner save that untreated china clay filler was used in the conventional manner instead of the filler/polymer conglomerates.

| | Basis weight (sheet) QSM | % total ash | Basis weight (fibre) QSM | Burst strength based on 100 g. fibre | Breaking length meters on sheet |
|---|---|---|---|---|---|
| Conglomerate | 53.1 | 14 | 45.66 | 199 | 4850 |
| China Clay filler | 52.0 | 9 | 47.3 | 197 | 4450 |

It can be seen from the foregoing results that by employing the present invention, the filler content of the paper sheet was substantially increased without any deterioration in the sheet strength. Thus the percentage increase in ash content was 55.5%, whilst the percentage increases in burst strength and breaking length (or tensile strength) were 1.0% and 8.9% respectively.

EXAMPLE 5

This Example illustrates the use of the invention in an acid papermaking system with china clay as filler.

A paper pulp furnish was made up in a conventional manner from fully bleached chemical pulps and recycled broke (made from a similar furnish), so that the furnish comprised 55 weight % of hardwood, 35 weight % of softwood and 10% of the recycled broke. Sufficient rosin/alum sizing agent was incorporated in the furnish to give a pH value of 5.5.

A commercially available homopolymer of acrylamide (having a molecular weight of about $5\times10^6$ and a viscosity equal to 82 c.p. units at 15° C. measured with a 0.5% by weight solution on a RVT Brookfield Viscometer at 50 r.p.m.) was dissolved in city water to give a 0.3% w/w solids polyacrylamide solution having a zeta potential of +1 ev. The viscous solution produced in this manner was pumped at a flow rate of about 220 liters per hour through a positive displacement pump into a feed line through which was passing a 25% w/w aqueous slurry of filler grade china clay at a flow rate of 2450 liters per hour, so as to give a percentage addition of polymer solution to wet filler flow of about 9.0. The polyacrylamide solution was fed into the filler feed line and the resultant mixture fed through a static mixer to ensure thorough blending.

The effluent from the static mixer which comprised china clay/polyacrylamide conglomerates suspended in water, the conglomerates having an average diameter in the range of 25 to 35 microns, was fed through a transparent plastics pipe into the papermaking system at a point before the mechanical screens for the furnish. A solution in water of a retention aid, the commercially available product Retaminol C (sold in the United Kingdom by Bayer) was added immediately before the flowbox to retain fines and to maximise size retention.

Woodfree continuous stationery was then produced on a papermaking machine using an acid system having a slightly positive zeta potential. Paper was produced at 4200 Kg. per hour at the reel end at a reel end speed of 600 meters per minute.

The following Table indicates the physical results obtained with the paper produced in accordance with the invention as described in the foregoing Example compared with the results obtained with paper produced in an identical manner save that untreated china clay filler was used in the conventional manner instead of the filler/ polymer conglomerates.

| | Basis weight (sheet) QSM | % total ash | Basis weight (fibre) QSM | Burst strength based on 100 g. fibre | Breaking length meters on sheet |
|---|---|---|---|---|---|
| Conglomerate | 52.5 | 12 | 46.2 | 197 | 4500 |
| China Clay filler | 52.0 | 9 | 47.3 | 197 | 4450 |

It can be seen from the foregoing results that by employing the present invention, the filler content of the paper sheet was substantially increased without any deterioration in the sheet strength. Thus the percentage increase on ash content was 33.3%, whilst the percentage increases on burst strength and breaking length were about 1% and 5% respectively.

EXAMPLE 6

This Example illustrates the use of the invention in an acid papermaking system with china clay as filler and a dry strength resin present during formation of the filler/polymer conglomerates.

A paper pulp furnish was made up in a conventional manner from fully bleached chemical pulps and recycled broke (made from a similar furnish), so that the furnish comprised 10 weight % of hardwood, 80 weight % of softwood and 10% of the recycled broke. A fortified rosin/alum sizing agent was incorporated in the furnish so as to give a pH of about 5.8.

A commercially available homopolymer of acrylamide (having a molecular weight of about $5\times10^6$ and a viscosity equal to 82 c.p. units at 15° C. measured with a 0.5% by weight solution on a RVT Brookfield Viscometer at 50 r.p.m.) together with 0.5% by weight, based on the weight of polyacrylamide, of a commercially available aqueous solution of a sulphited melamine formaldehyde dry-strength resin (sold in the United Kingdom by British Industrial Plastics Limited) were added to city water to give a 0.4% w/w solids polyacrylamide solution having a zeta potential of −20 ev. The viscous solution produced in this manner was pumped at a flow rate of about 186 liters per hour through a positive displacement pump into a feed line through which was passing a 20% w/w aqueous slurry of china clay at a flow rate of 1550 liters per hour, so as to give a percentage addition of polymer solution to wet filler flow of about 20%. The polyacrylamide solution was fed into the filler feed line and the resultant mixture fed through a static mixer to ensure thorough blending.

The effluent from the static mixer which comprised china clay/polyacrylamide conglomerates suspended in water, the conglomerates having an average diameter in the range of 85 to 95 microns, was fed through a transparent plastics pipe into the flowbox manifold of a papermaking machine. No retention aid was added to the furnish.

Paper of sugar bag liner grade was then produced on the papermaking machine using an acid system having a slightly positive zeta potential. Paper was produced at 2000 Kg. per hour at the reel end at a reel end speed of 100 meters per minute.

The following Table indicates the physical results obtained with the paper produced in accordance with the invention as described in the foregoing Example compared with the results obtained with paper produced in an identical manner save that untreated china clay filler was used in the conventional manner instead of the filler/polymer conglomerates.

| | Basis weight (sheet) QSM | % total ash | Basis weight (fibre) QSM | Burst strength based on 100 g.fibre | Breaking length meters on sheet |
|---|---|---|---|---|---|
| Conglomerate | 67.2 | 12.3 | 59.1 | 440 | 7820 |
| China Clay filler | 64.6 | 8.7 | 59.0 | 424 | 6830 |

It can be seen from the foregoing results that by employing the present invention, the filler content of the paper sheet was substantially increased without any deterioration in the sheet strength. Thus the percentage increase in ash content was 34.5%, whilst the percentage increases in burst strength and breaking length (or tensile strength) were 3.7% and 23.5% respectively.

We claim:

1. A method of manufacturing paper sheet from cellulose pulp on a papermaking machine which permits an increase in the filler content of the paper sheet, in both acidic and alkaline papermaking systems, without any substantial loss in strength, comprising: forming modified mineral filler conglomerates by contacting an aqueous suspension of a particulate mineral filler with a polymer of acrylamide having a zeta potential in the range of from −40 to +40 electron volts and a molecular weight in the range of from $2\times10^6$ to $20\times10^6$, and incorporating the mineral filler conglomerates into the cellulose pulp prior to feeding the cellulose pulp containing the conglomerates to a continuous wire mesh at the wet end of the papermaking machine.

2. A method according to claim 1, wherein the polymer has a molecular weight in the range from $4\times10^6$ to $12\times10^6$.

3. A method according to claim 1, wherein the polymer has a zeta potential in the range from +5 to −20 electron volts and a molecular weight in the range from about $5\times10^6$ to $10\times10^6$.

4. A method according to claim 3, wherein the polymer is an essentially non-ionic homopolymer of acrylamide.

5. A method according to claim 1, wherein the conglomerates contain from 0.01 to 0.5% by weight of dry polymer, based on dry weight of filler.

6. A method according to claim 1, wherein the filler/polymer conglomerates have an average diameter in the range from 50 to 100 microns.

7. A method according to claim 1, wherein the filler/polymer conglomerates are prepared by adding an aqueous solution of the polymer to an aqueous suspension of the filler and applying a low shearing force to the resulting mixture to reduce variations in the particle size of said conglomerates.

8. A method according to claim 1, wherein the filler and polymer are contacted in the presence of a wet-strength or dry-strength resin or a starch.

9. A method of manufacturing paper sheet in accordance with claim 1, which comprises continuously incorporating into an aqueous paper pulp a plurality of filler/polymer conglomerates formed by continuously contacting a flowing aqueous suspension of particulate mineral filler with a solution of said polymer and feeding the resulting loaded furnish to the wire at the wet end of a papermaking machine.

10. A method according to claim 9, wherein the aqueous paper pulp is alkaline and the mineral filler is calcium carbonate.

11. A method according to claim 9, wherein the aqueous paper pulp is acidic and the mineral filler is calcium carbonate.

12. The process of claim 1 wherein the filler is selected from the group consisting of calcium carbonate, china clay, talc or titanium dioxide.

13. The process of claim 1 wherein the filler is china clay.

14. A paper sheet produced in accordance with the method of claim 1.

* * * * *